US006588507B2

(12) United States Patent
Dusterhoft et al.

(10) Patent No.: US 6,588,507 B2
(45) Date of Patent: Jul. 8, 2003

(54) APPARATUS AND METHOD FOR PROGRESSIVELY GRAVEL PACKING AN INTERVAL OF A WELLBORE

(75) Inventors: Ronald G. Dusterhoft, Katy, TX (US); Syed Hamid, Dallas, TX (US); Roger L. Schultz, Aubrey, TX (US); Robert Ken Michael, Plano, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/894,080

(22) Filed: Jun. 28, 2001

(65) Prior Publication Data

US 2003/0000701 A1 Jan. 2, 2003

(51) Int. Cl.[7] ..... E21B 43/04; E21B 29/02

(52) U.S. Cl. ..... 166/278; 166/51; 166/63; 166/376

(58) Field of Search ..... 166/51, 63, 205, 166/278, 286, 297, 317, 376

(56) References Cited

U.S. PATENT DOCUMENTS

| | | | | |
|---|---|---|---|---|
| 2,342,913 A | | 2/1944 | Williams et al. | |
| 2,344,909 A | | 3/1944 | Williams et al. | |
| 4,945,991 A | | 8/1990 | Jones | 166/278 |
| 5,082,052 A | | 1/1992 | Jones et al. | 166/51 |
| 5,113,935 A | | 5/1992 | Jones et al. | 166/51 |
| 5,161,613 A | | 11/1992 | Jones | 166/242 |
| 5,161,618 A | | 11/1992 | Jones et al. | 166/308 |
| 5,332,039 A | * | 7/1994 | Primeaux et al. | 166/278 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Banbang T. Santoso of Repsol–YPF. Society of Petroleum Engineers, Inc., Mar., 2001.

(List continued on next page.)

*Primary Examiner*—David Bagnell
*Assistant Examiner*—Brian Halford
(74) *Attorney, Agent, or Firm*—Paul I. Herman; Lawrence R. Youst

(57) ABSTRACT

An apparatus (38) and method for progressively gravel packing an interval of a wellbore (32) is disclosed. The apparatus (38) comprises a sand control screen (52) that is positioned within the wellbore (32) and a tubular member (42) that is disposed within the wellbore (32) forming a first annulus (56) with the sand control screen (52) and a second annulus (58) with the wellbore (32). The tubular member (42) initially prevents fluid communication between the first annulus (56) and the second annulus (58). Once the gravel packing operation begins, however, the tubular member (42) selectively allows fluid communication from the first annulus (56) to the second annulus (58) by progressively establishing fluid communication between the first annulus (56) and the second annulus (58) from a first end of the interval (48) to a second end of the interval (48).

48 Claims, 10 Drawing Sheets

U.S. PATENT DOCUMENTS

| | | | | |
|---|---|---|---|---|
| 5,333,688 | A | 8/1994 | Jones et al. | 166/278 |
| 5,355,956 | A | 10/1994 | Restarick | 166/296 |
| 5,390,966 | A | 2/1995 | Cox et al. | 285/137.1 |
| 5,419,394 | A | 5/1995 | Jones | 166/51 |
| 5,443,117 | A | 8/1995 | Ross | 166/51 |
| 5,476,143 | A | 12/1995 | Sparlin et al. | 166/233 |
| 5,515,915 | A | 5/1996 | Jones et al. | 166/51 |
| 5,588,487 | A | 12/1996 | Bryant | 166/51 |
| 5,636,691 | A | 6/1997 | Hendrickson et al. | 166/278 |
| 5,755,286 | A | 5/1998 | Ebinger | 166/281 |
| 5,842,516 | A | 12/1998 | Jones | 166/56 |
| 5,848,645 | A | 12/1998 | Jones | 166/280 |
| 5,868,200 | A | 2/1999 | Bryant et al. | 166/51 |
| 5,890,533 | A | 4/1999 | Jones | 166/51 |
| 5,921,318 | A | 7/1999 | Ross | 166/250.17 |
| 5,934,376 | A | 8/1999 | Nguyen et al. | 166/278 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,343,651 | B1 | 2/2002 | Bixenman | 166/278 |

OTHER PUBLICATIONS

"CAPS$^{SM}$ Concentric Annular Packing Service for Sand Control," Halliburton Energy Services, Inc., Aug., 2000.

"CAPS$^{SM}$ Sand Control Service for Horizontal Completions Improves Gravel Pack Reliability and Increases Production Potential from Horizontal Completions," Halliburton Energy Services, Inc., Aug., 2000.

"Frac Pack Technology Still Evolving," Charles D. Ebinger of Ely & Associates Inc.; Oil & Gas Journal, Oct. 23, 1995.

"Mechanical Fluid–Loss Control Systems Used During Sand Control Operations," H.L. Restarick of Otis Engineering Corp., 1992.

"Sand Control Screens," Halliburton Energy Services, 1994.

* cited by examiner

APPARATUS AND METHOD FOR PROGRESSIVELY GRAVEL PACKING AN INTERVAL OF A WELLBORE

TECHNICAL FIELD OF THE INVENTION

This invention relates in general to preventing the production of particulate materials through a wellbore traversing an unconsolidated or loosely consolidated subterranean formation and, in particular, to an apparatus and method for progressively gravel packing an interval of the wellbore.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulates. For example, the particulates cause abrasive wear to components within the well, such as tubing, pumps and valves. In addition, the particulates may partially or fully clog the well creating the need for an expensive workover. Also, if the particulate matter is produced to the surface, it must be removed from the hydrocarbon fluids using surface processing equipment.

One method for preventing the production of such particulate material to the surface is gravel packing the well adjacent to the unconsolidated or loosely consolidated production interval. In a typical gravel pack completion, a sand control screen is lowered into the wellbore on a workstring to a position proximate the desired production interval. A fluid slurry including a liquid carrier and a relatively coarse particulate material, which is typically sized and graded and which is referred to herein as gravel, is then pumped down the workstring and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It has also been found, however, that it is difficult to completely gravel pack the production interval. This is particularly true in long or inclined/horizontal production intervals. The resulting incomplete gravel packs are commonly caused by entry of the liquid carrier into permeable sections of the production interval creating sand bridge formation in the annulus. Thereafter, the sand bridge prevents the gravel pack slurry from flowing to the remainder of the annulus which, in turn, prevents the placement of sufficient gravel in the remainder of the annulus.

Therefore a need has arisen for an apparatus and method that is capable of producing a substantially complete gravel pack of the wellbore adjacent to the production interval to prevent the production of fine particulate materials when production from the formation commences.

SUMMARY OF THE INVENTION

The present invention disclosed herein comprises an apparatus and method that is capable of producing a substantially complete gravel pack of the wellbore adjacent to the production interval to prevent the production of fine particulate materials when production commences. The apparatus and method of the present invention achieves this result by progressively gravel packing the production interval from one end to the other.

The apparatus comprises a sand control screen that is positioned within the wellbore and a tubular member also positioned within the wellbore forming a first annulus with the sand control screen and a second annulus with the wellbore. The tubular member initially substantially prevents fluid communication between the first annulus and the second annulus. Thereafter, the tubular member selectively allows fluid communication from the first annulus to the second annulus by progressively establishing fluid communication between the first annulus and the second annulus from a first end to a second end of the interval.

The tubular member may include a perforated pipe having a plurality of removable members positioned on the interior or the exterior of the perforated pipe. The removable members may alternatively be positioned within the wellbore without being associated with a perforated pipe. In either case, the removable members may be propellant or other combustible material members each having an initiator. The initiators may be activated by a wireless telemetry system. Alternatively, the initiators may have pressure activated firing devices that are positioned such that the pressure required to fire the pressure activated firing devices progressively increasing from the first end to the second end interval.

The removable members may alternatively be friable members that are progressively removable from the first end to the second end of the interval. Each friable member may include a pressure actuated vibration generator. In this case, the pressure actuated vibration generators are positioned within the wellbore such that the pressure required to activate the pressure actuated vibration generators progressively increasing from the first end to the second end of the interval. Alternatively, each of the friable members may have a vibration generator that activated by a wireless telemetry system.

The tubular member may alternatively comprises a perforated pipe having an actuatable device disposed within each perforation. The actuatable devices may be rupture disks, pressure actuated one-way valves or other pressure actuated devices that are positioned within the perforated pipe such that the pressure required to actuate the actuatable devices progressively increases from the first end to the second end of the interval. Alternatively, the actuatable device may be progressively actuated from the first end to the second end of the interval by a wireless telemetry system.

In all embodiments, the gravel pack may progress from the top of the interval to the bottom, the bottom of the interval to the top, the heel of the interval to the toe or the toe of the interval to the heel.

The method of the present invention comprises traversing a formation with the wellbore, locating a sand control screen within the wellbore proximate the formation, positioning a tubular member within the wellbore that forms a first annulus between the tubular member and the sand control screen and a second annulus between the tubular member and the wellbore, initially substantially preventing fluid communication between the first annulus and the second annulus, injecting a fluid slurry containing gravel into the first annulus, progressively establishing fluid communication between the first annulus and the second annulus from a first end to a second end of the interval and terminating the injecting when the interval is substantially completely packed with the gravel.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
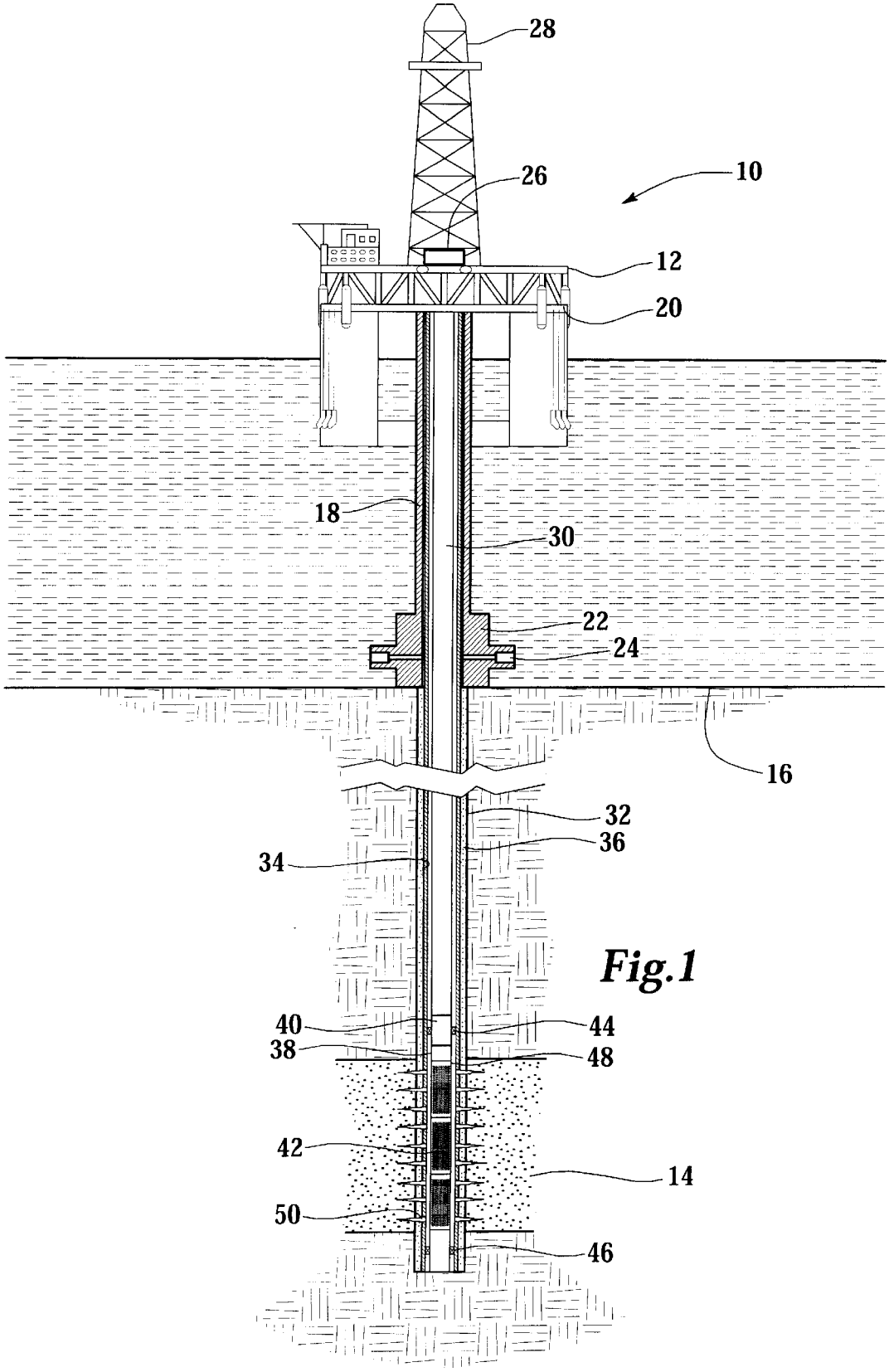
FIG. 1 is a schematic illustration of an offshore oil and gas platform operating an apparatus for progressively gravel packing an interval of a wellbore of the present invention.

Referring initially to FIG. 1, an apparatus for progressively gravel packing an interval of a wellbore operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including apparatus 38 for progressively gravel packing an interval of wellbore 32 adjacent to formation 14. Apparatus 38 includes a cross-over assembly 40 and a gravel packing assembly 42 which is used to gravel pack the production interval 48 between packers 44, 46. When it is desired to gravel pack interval 48, work string 30 is lowered through casing 34 until apparatus 38 is positioned adjacent to formation 14 including perforations 50. Thereafter, a fluid slurry containing gravel is pumped down work string 30 through apparatus 38 to progressively gravel pack interval 48.

Even though FIG. 1 depicts a vertical well, it should be noted by one skilled in the art that the apparatus for progressively gravel packing an interval of a wellbore of the present invention is equally well-suited for use in deviated wells, inclined wells or horizontal wells. Also, even though FIG. 1 depicts an offshore operation, it should be noted by one skilled in the art that the apparatus for progressively gravel packing an interval of a wellbore of the present invention is equally well-suited for use in onshore operations.

Figure 2:
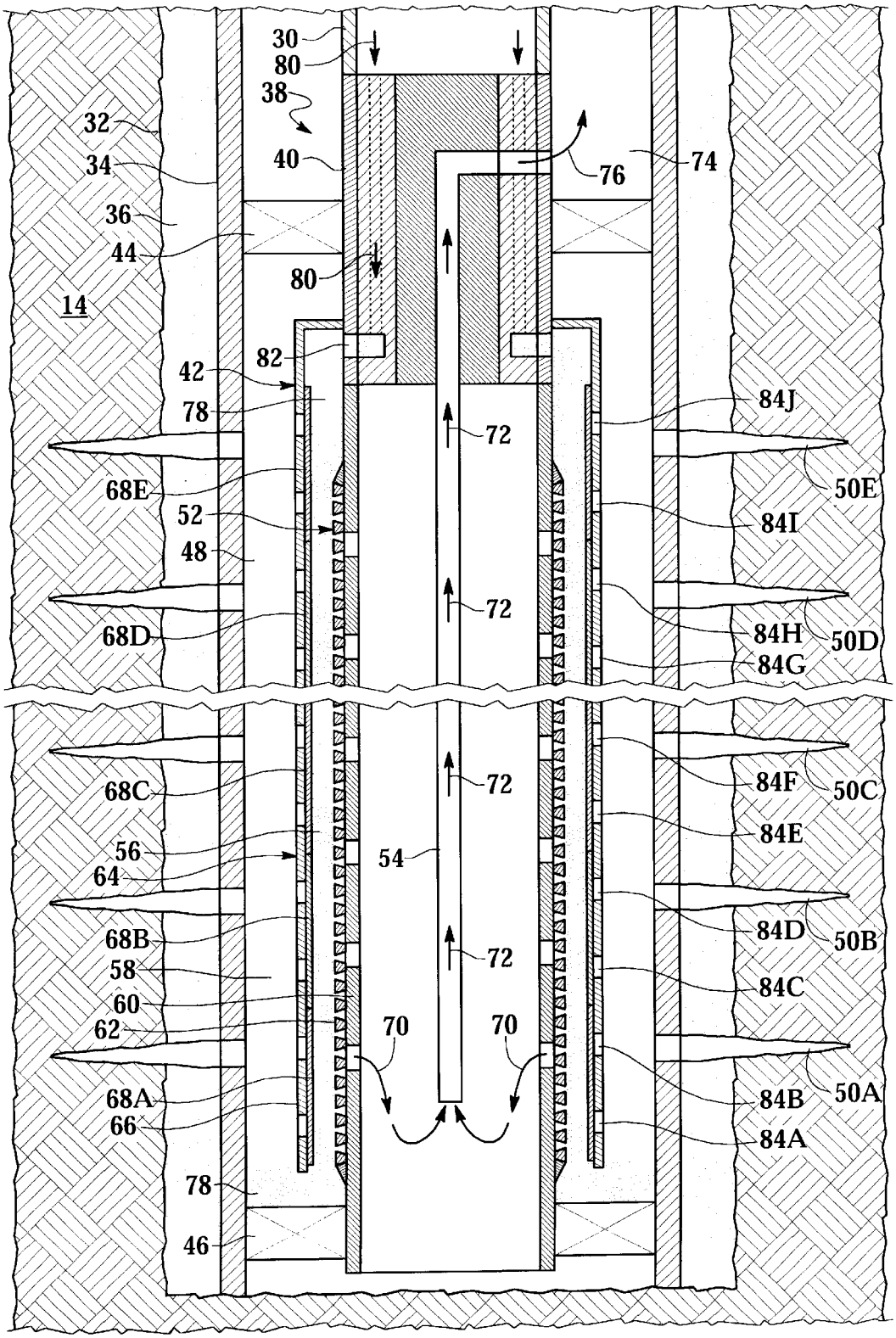
FIG. 2 is a half sectional view of an apparatus for progressively gravel packing an interval of a wellbore of the present invention in its initial position.

Referring now to FIG. 2, therein is depicted a more detailed illustration of apparatus 38. As illustrated, apparatus 38 includes cross-over assembly 40, a screen assembly 52, gravel packing assembly 42 and a wash pipe 54. Apparatus 38 is connected to work string 30 extending from the surface, which lowers apparatus 38 into wellbore 32 until screen assembly 52 is properly positioned adjacent to formation 14. Gravel packing apparatus 42 forms an annulus 56 with screen assembly 52 and an annulus 58 with casing 34.

Screen assembly 52 is designed to allow fluid to flow therethrough but prevent particulate matter of sufficient size from flowing therethrough. The exact design of screen assembly 52 is not critical to the present invention as long as it is suitably designed for the characteristics of the formation fluids and the gravel pack slurry. For example, as illustrated, screen assembly 52 may include a perforated base pipe 60 having a wire 62 wrapped directly thereon. Alternatively, a plurality of ribs may be placed around the base pipe to provide stand off between the base pipe and the wire wrap. Another suitable alternative is to use a screen assembly having a sinterred wire mesh or sinterred metal between the base pipe and an outer housing.

In the illustrated embodiment, gravel packing apparatus 42 includes an axially extending substantially tubular member 64 that includes a perforated pipe 66 and a plurality of progressively removable members 68A–68E disposed on the interior of perforated pipe 66. Removable members 68A–68E may be constructed from a variety of materials such as combustible materials, referred to herein as propellants, that are removable by combustion, friable materials, including ceramics, that are removable by disintegration, or other materials that are removable in a downhole environment.

When removable members 68A–68E are constructed from propellants, suitable initiators are attached to each removable member 68A–68E such that the combustion process of each removable member 68A–68E may be triggered independently. The initiators may be operated using a variety of known techniques including pressure actuation, electrical actuation, acoustic actuation or the like. For example, as explained in more detail below, the pressure generated by the fluid slurry containing gravel can be used to trigger the initiators. Alternatively, a wireless telemetry system can be used wherein pressure pulses, electromagnetic waves, acoustic signals or the like are used to the operate the initiators.

When removable members 68A–68E are constructed from friable materials, suitable vibration generators are attached to each removable member 68A–68E such that the disintegration process of each removable member 68A–68E may be triggered independently. The vibration generators may be operated using a variety of known techniques including pressure actuation, electrical actuation, acoustic actuation or the like. For example, as explained in more detail below, the pressure generated by the fluid slurry containing gravel can be used to trigger the vibration generators. Alternatively, a wireless telemetry system can be used wherein pressure pulses, electromagnetic waves, acoustic signals or the like are used to the operate the vibration generators.

To begin the completion process, interval 48 adjacent to formation 14 is isolated. Packer 44 seals the upper end of interval 48 and packer 46 seals the lower end of interval 48. Cross-over assembly 40 is located adjacent to screen assembly 52, traversing packer 44 with portions of cross-over assembly 40 on either side of packer 44. When the gravel packing operation commences, the objective is to uniformly and completely fill interval 48 with gravel. To help achieve this result, wash pipe 54 is disposed within screen assembly 52. Wash pipe 54 extends into cross-over assembly 40 such that return fluid passing through screen assembly 52, indicated by arrows 70, may travel through wash pipe 54, as indicated by arrow 72, and into annulus 74, as indicted by arrow 76, for return to the surface.

The fluid slurry containing gravel 78 is pumped down work string 30 into cross-over assembly 40 along the path indicated by arrows 80. The fluid slurry containing gravel 78 exits cross-over assembly 40 through cross-over ports 82 and is discharged into annulus 56. In the illustrated embodiment, the fluid slurry containing gravel 78 then travels through annulus 56 to the end of interval 48. At this point, a portion of fluid slurry containing gravel 78 may leak off into annulus 58 as a fluid tight seal is not created. Nonetheless, as gravel packing assembly 52 is designed to initially substantially prevent fluid communication between annulus 56 and annulus 58, the pressure within annulus 56 will begin to increase, indicating that the fluid slurry containing gravel 78 has reached the end of interval 48.

Figure 3:
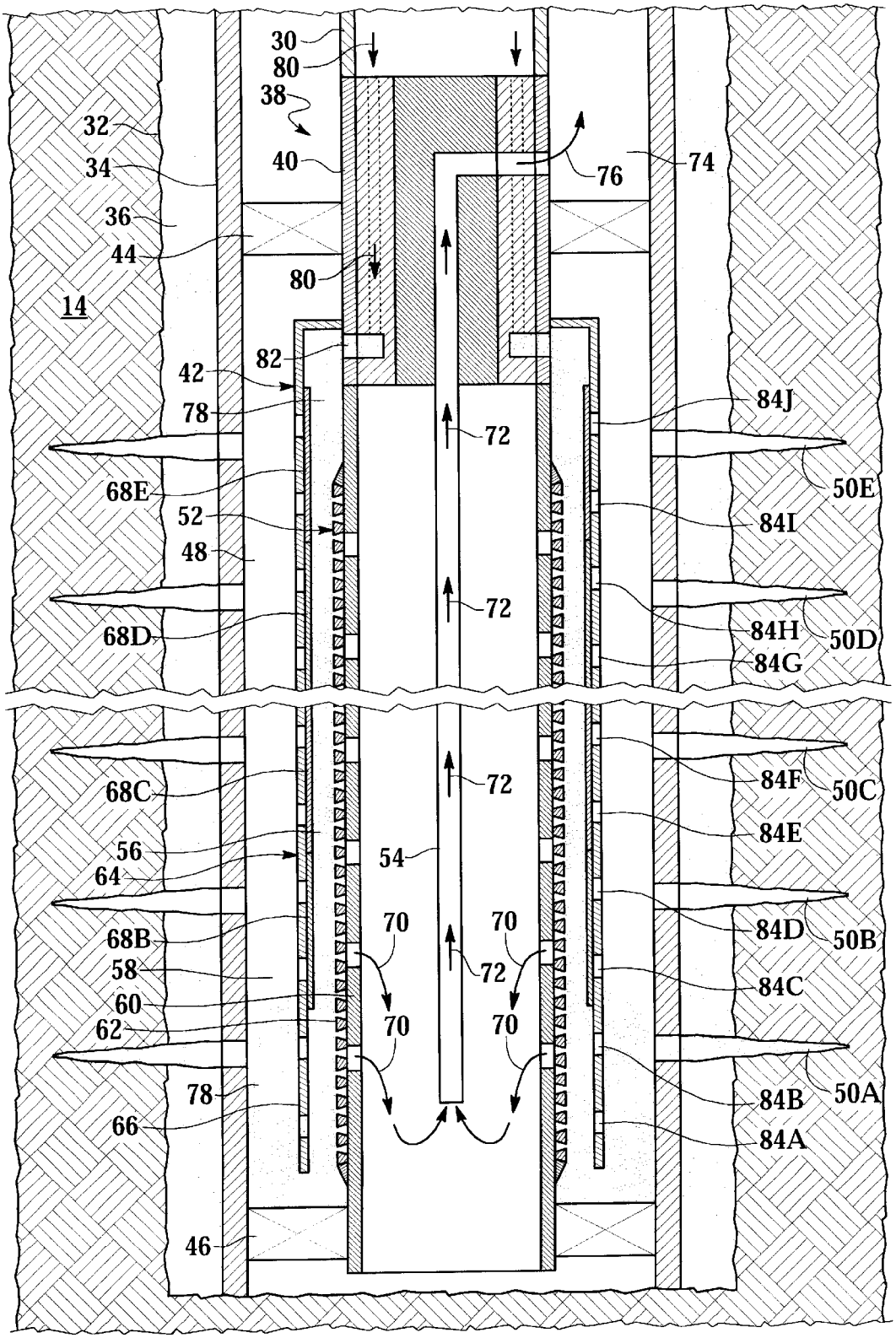
FIG. 3 is a half sectional view of an apparatus for progressively gravel packing an interval of a wellbore of the present invention after the first progression of the apparatus.

Once the pressure in annulus 56 begins to increase, the operation of gravel packing assembly 52 may begin which provides for the progressive gravel packing of interval 48. Specifically, as best seen in FIG. 3, removable member 68A is removed which allows the fluid slurry containing gravel 78 to travel from annulus 56 to annulus 58 through perforations 84A–84B. As the fluid slurry containing gravel 78 enters annulus 58, the gravel 78 drops out of the slurry and builds up from formation 14, filling perforation 50A, annulus 56 and annulus 58 around the end section of screen assembly 52 forming the initial portion of the gravel pack. Some of the carrier fluid in the slurry may leak off through perforation 50A into formation 14 while the remainder of the carrier fluid pass through screen assembly 52, as indicated by arrows 70, that is sized to prevent gravel 78 from flowing therethrough. The fluid flowing back through screen assembly 52, as explained above, follows the paths indicated by arrows 72, 76 back to the surface.

Figure 4:
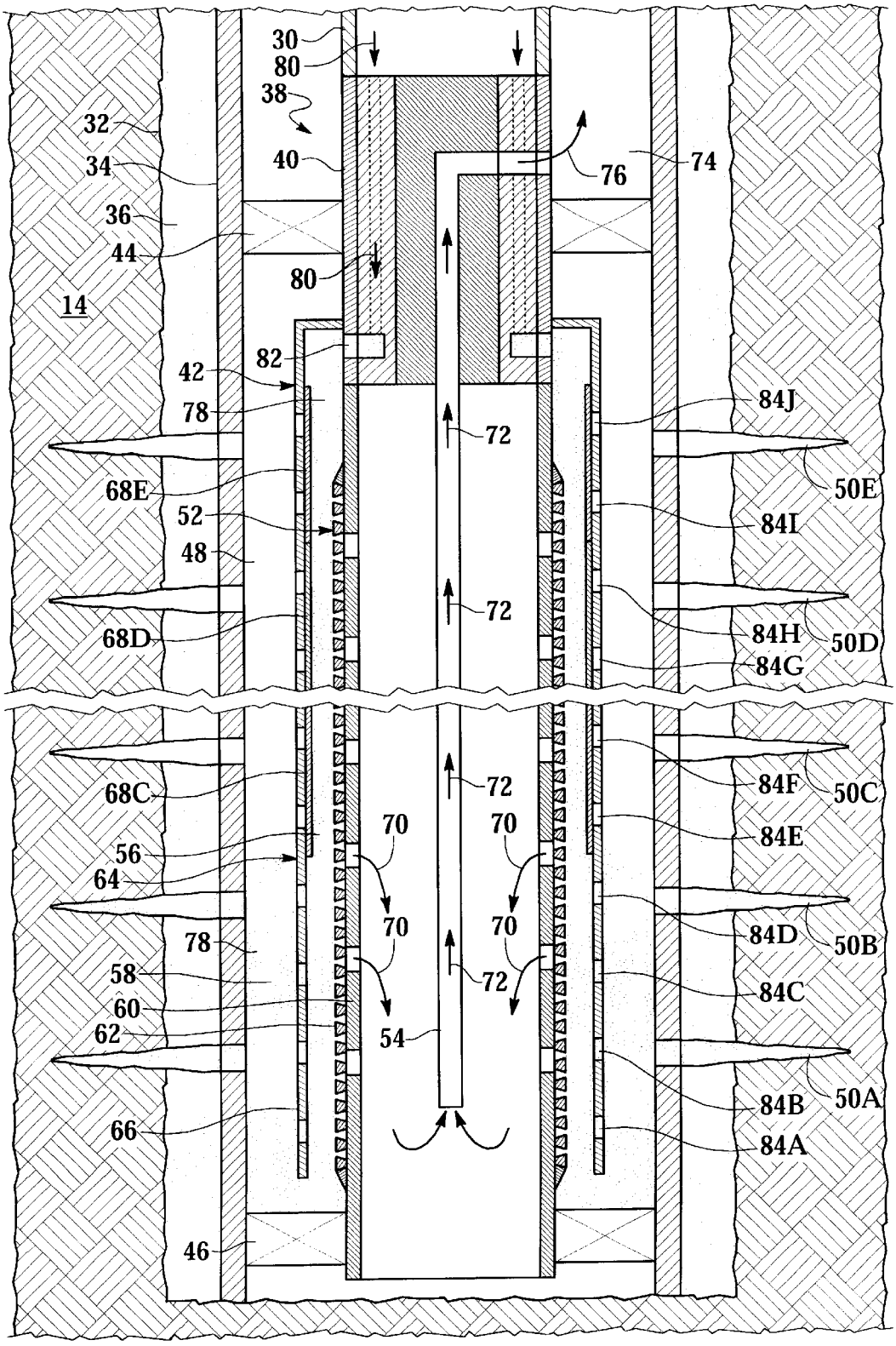
FIG. 4 is a half sectional view of an apparatus for progressively gravel packing an interval of a wellbore of the present invention after the second progression of the apparatus.

As the initial portion of the gravel pack becomes tightly packed, the pressure in annulus 56 again increases. At this point and as best seen in FIG. 4, removable member 68B is removed which allows the fluid slurry containing gravel 78 to travel from annulus 56 to annulus 58 through perforations 84C–84D. As the fluid slurry containing gravel 78 enters annulus 58, the gravel 78 drops out of the slurry and builds up from formation 14, filling perforation 50B, annulus 56 and annulus 58 around the adjacent section of screen assembly 52 forming the next portion of the gravel pack. While some of the carrier fluid in the slurry may leak off through perforation 50B into formation 14, the remainder of the carrier fluid passes through screen assembly 52, as indicated by arrows 70 and returns to the surface as indicated by arrows 72, 76.

Figure 5:
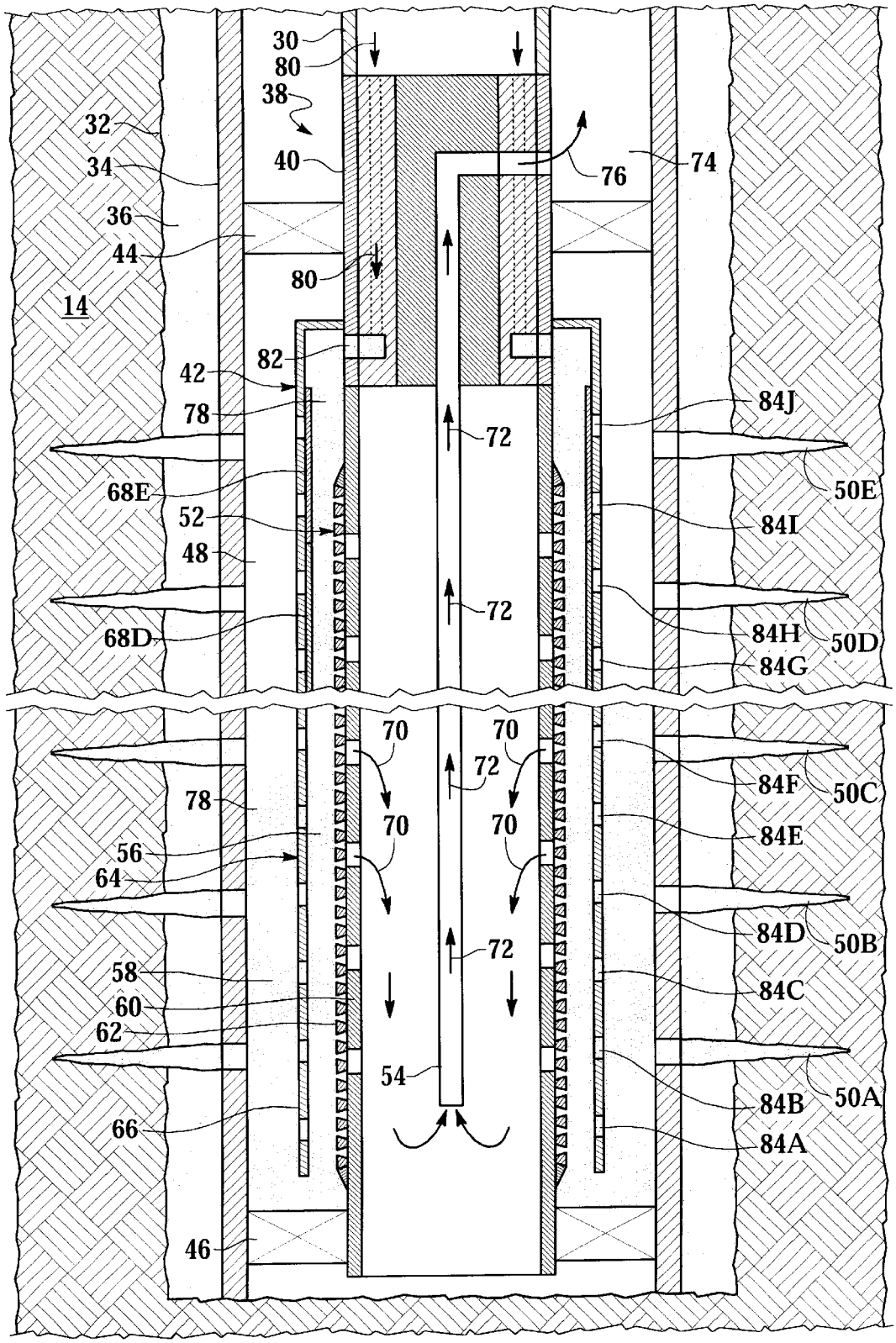
FIG. 5 is a half sectional view of an apparatus for progressively gravel packing an interval of a wellbore of the present invention after the third progression of the apparatus.

As this portion of the gravel pack becomes tightly packed, the pressure in annulus 56 again increases. At this point and as best seen in FIG. 5, removable member 68C is removed which allows the fluid slurry containing gravel 78 to travel from annulus 56 to annulus 58 through perforations 84E–84F. As the fluid slurry containing gravel 78 enters annulus 58, the gravel 78 drops out of the slurry and builds up from formation 14, filling perforation 50C, annulus 56 and annulus 58 around the adjacent section of screen assembly 52 forming the next portion of the gravel pack. While some of the carrier fluid in the slurry may leak off through perforation 50C into formation 14, the remainder of the carrier fluid passes through screen assembly 52, as indicated by arrows 70 and returns to the surface as indicated by arrows 72, 76.

Figure 6:
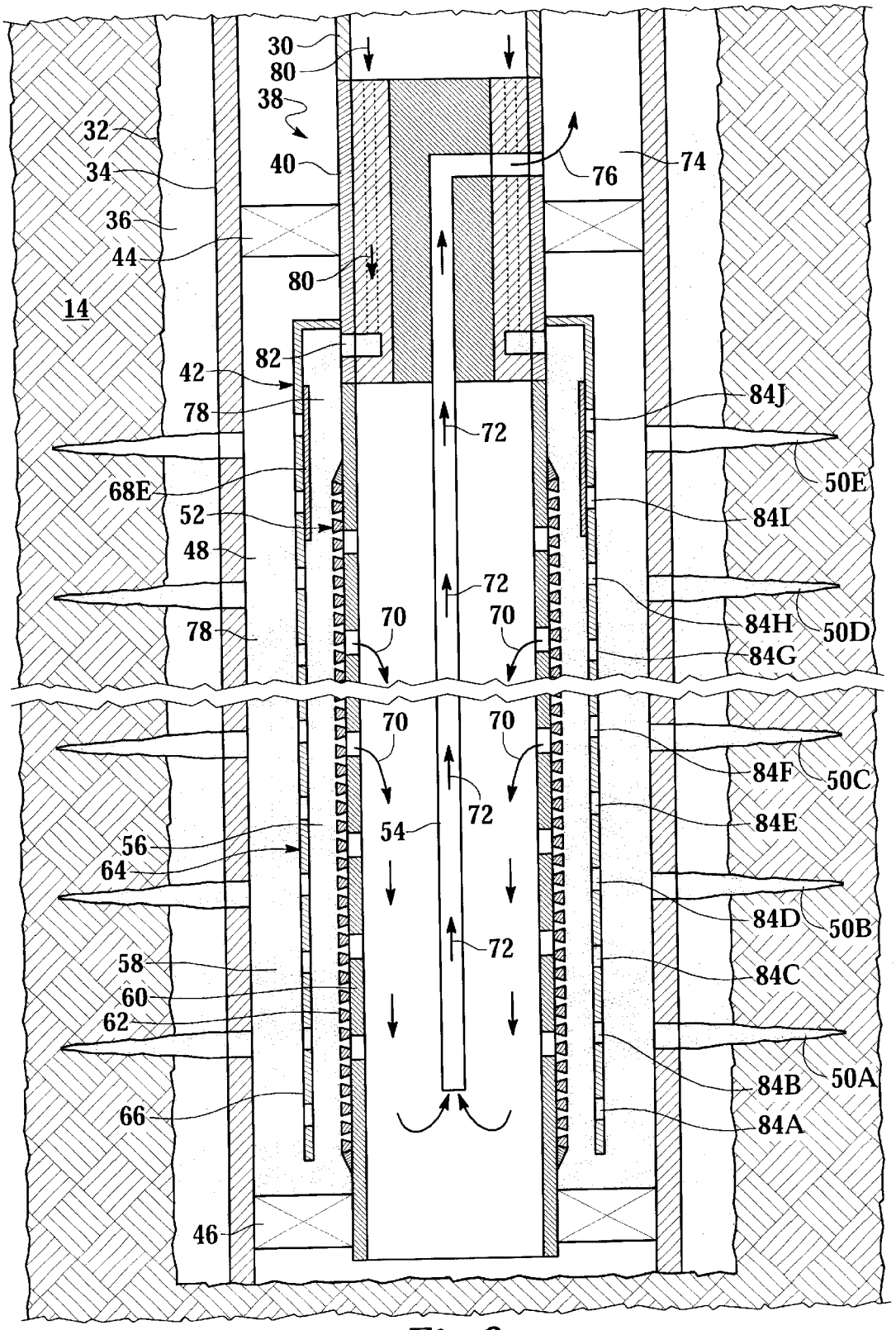
FIG. 6 is a half sectional view of an apparatus for progressively gravel packing an interval of a wellbore of the present invention after the next to last progression of the apparatus.

This process continues to progress back from the end of interval 48 toward cross-over assembly 40. Specifically, as best seen in FIG. 6, removable member 68D is removed which allows the fluid slurry containing gravel 78 to travel from annulus 56 to annulus 58 through perforations 84G–84H. As the fluid slurry containing gravel 78 enters annulus 58, the gravel 78 drops out of the slurry and builds up from formation 14, filling perforation 50D, annulus 56 and annulus 58 around the adjacent section of screen assembly 52 forming the next portion of the gravel pack. While some of the carrier fluid in the slurry may leak off through perforation 50D into formation 14, the remainder of the carrier fluid passes through screen assembly 52, as indicated by arrows 70 and returns to the surface as indicated by arrows 72, 76.

Figure 7:
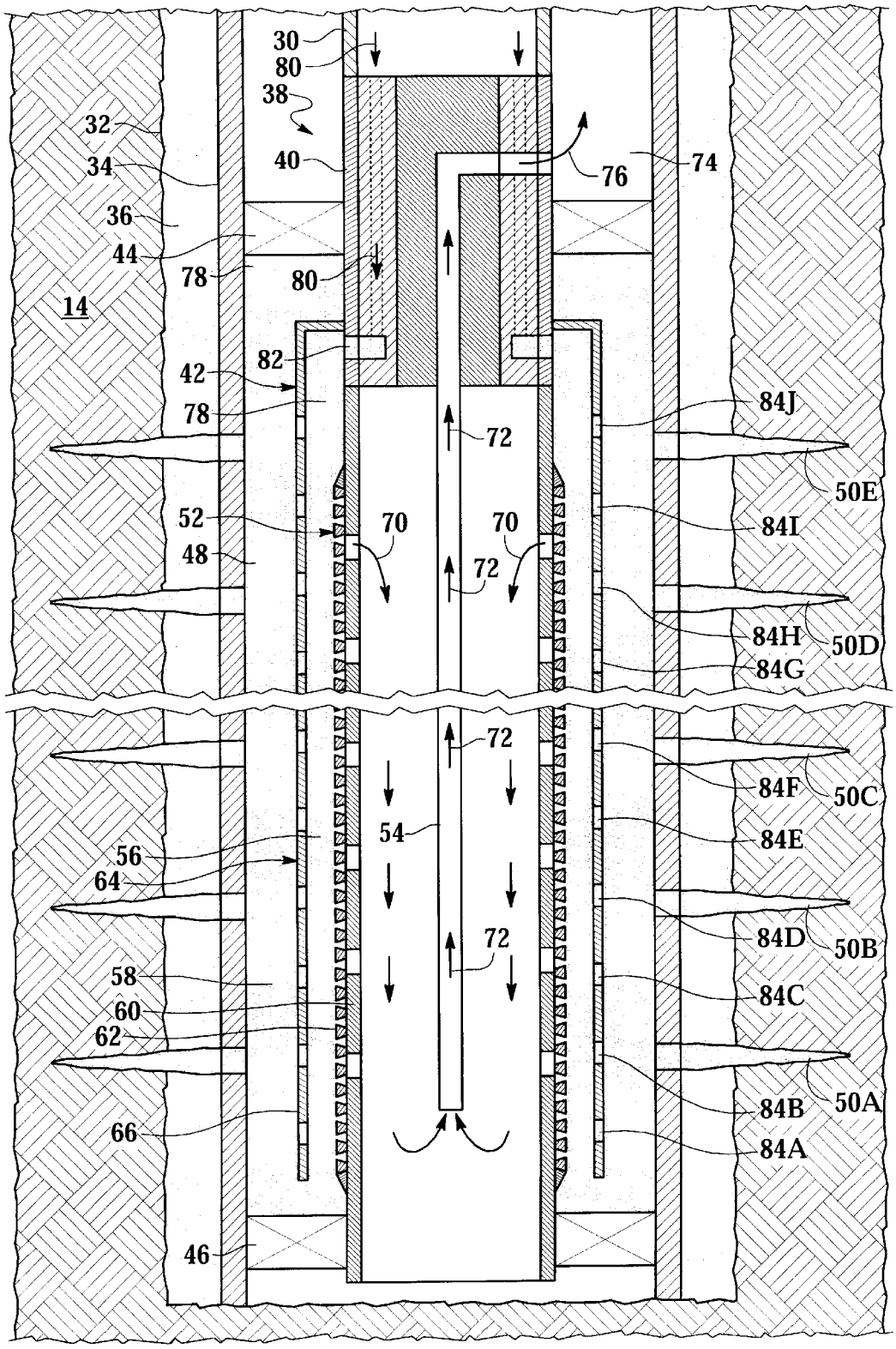
FIG. 7 is a half sectional view of an apparatus for progressively gravel packing an interval of a wellbore of the present invention after the last progression of the apparatus.

As this portion of the gravel pack becomes tightly packed, the pressure in annulus 56 again increases. At this point and as best seen in FIG. 7, the last removable member, removable member 68E, is removed which allows the fluid slurry containing gravel 78 to travel from annulus 56 to annulus 58 through perforations 84I–84J. As the fluid slurry containing gravel 78 enters annulus 58, the gravel 78 drops out of the slurry and builds up from formation 14, filling perforation 50E, annulus 56 and annulus 58 around the adjacent section of screen assembly 52 to packer 44 forming the last portion of the gravel pack. While some of the carrier fluid in the slurry may leak off through perforation 50E into formation 14, the remainder of the carrier fluid passes through screen assembly 52, as indicated by arrows 70 and returns to the surface as indicated by arrows 72, 76.

As can be seen, using the apparatus for progressively packing an interval of a wellbore of the present invention, the gravel pack progresses from one end of interval 48 toward the other end as fluid communication is progressively allowed between annulus 56 and annulus 58. Also, as should be apparent to those skilled in the art, even though FIGS. 2–7 present the apparatus for progressively gravel packing an interval of a wellbore of the present invention in a vertical orientation with packer 44 at the top of interval 48 and packer 46 at the bottom of interval 48, these figures are intended to also represent wellbores that have alternate directional orientations such as inclined wellbores and horizontal wellbore. In the horizontal orientation, for example, packer 44 is at the heel of interval 48 and packer 46 is at the toe of interval 48.

Likewise, even though FIGS. 2–7 present the apparatus for progressively gravel packing an interval of a wellbore of the present invention performing a progressive gravel pack from the bottom of the interval to the top of the interval, in the vertical orientation, or the toe of the interval to heel of the interval, in the horizontal orientation, those skilled in the art will understand that the apparatus for progressively gravel packing an interval of a wellbore of the present invention can alternatively be configured to progressively gravel pack from the top of the interval to the bottom of the interval, in the vertical orientation, or the heel of the interval to toe of the interval, in the horizontal orientation.

As stated above, there are numerous ways to remove removable members 68 from perforated pipe 66 to progressively establish fluid communication between annulus 56 and annulus 58. One preferred method allows the pressure created by the fluid slurry within annulus 56 to progressively trigger the removal of removable member 68. For example, when the removable members 68 are constructed of propellant material, pressure activated firing devices may be attached to initiators that are coupled on each of the removable members 68. The pressure activated firing devices are then positioned within wellbore 32 such that the pressure required to fire the pressure activated firing devices progressively increases from the end of interval 48 toward cross-over assembly 40. Each adjacent pressure activated firing device may be set to fire at an incremental pressure above the prior pressure activated firing device such as at increments of between about 50–100 psi. This assures a proper progression of the gravel pack by preventing any out of sequence activations. In addition, this approach is particularly advantageous in that the incremental pressure increase of adjacent pressure activated firing devices helps to insure that each section of the gravel pack is tightly packed prior to initiating the gravel packing of subsequent sections.

Alternatively, a wireless telemetry system may be used to progressively trigger the removal of removable member 68. For example, when the removable members 68 are constructed of a friable material, vibration generators may be coupled on each of the removable members 68. Each vibration generator is activated by a particular wireless signal addressed specifically for that vibration generator. This assures a proper progression of the gravel pack by preventing any out of sequence activations. The wireless signals may be manually or automatically sent based upon the pressure response in annulus 56. For example, the wireless signal to remove the next removable member 68 may be sent each time the pressure within annulus 56 reaches a particular level or each time the pressure within annulus 56 reaches the next preselected pressure increment. As with the direct pressure response method, the particular removal sequence should insure that each section of the gravel pack is tightly packed prior to initiating the gravel packing of subsequent sections.

Figure 8:
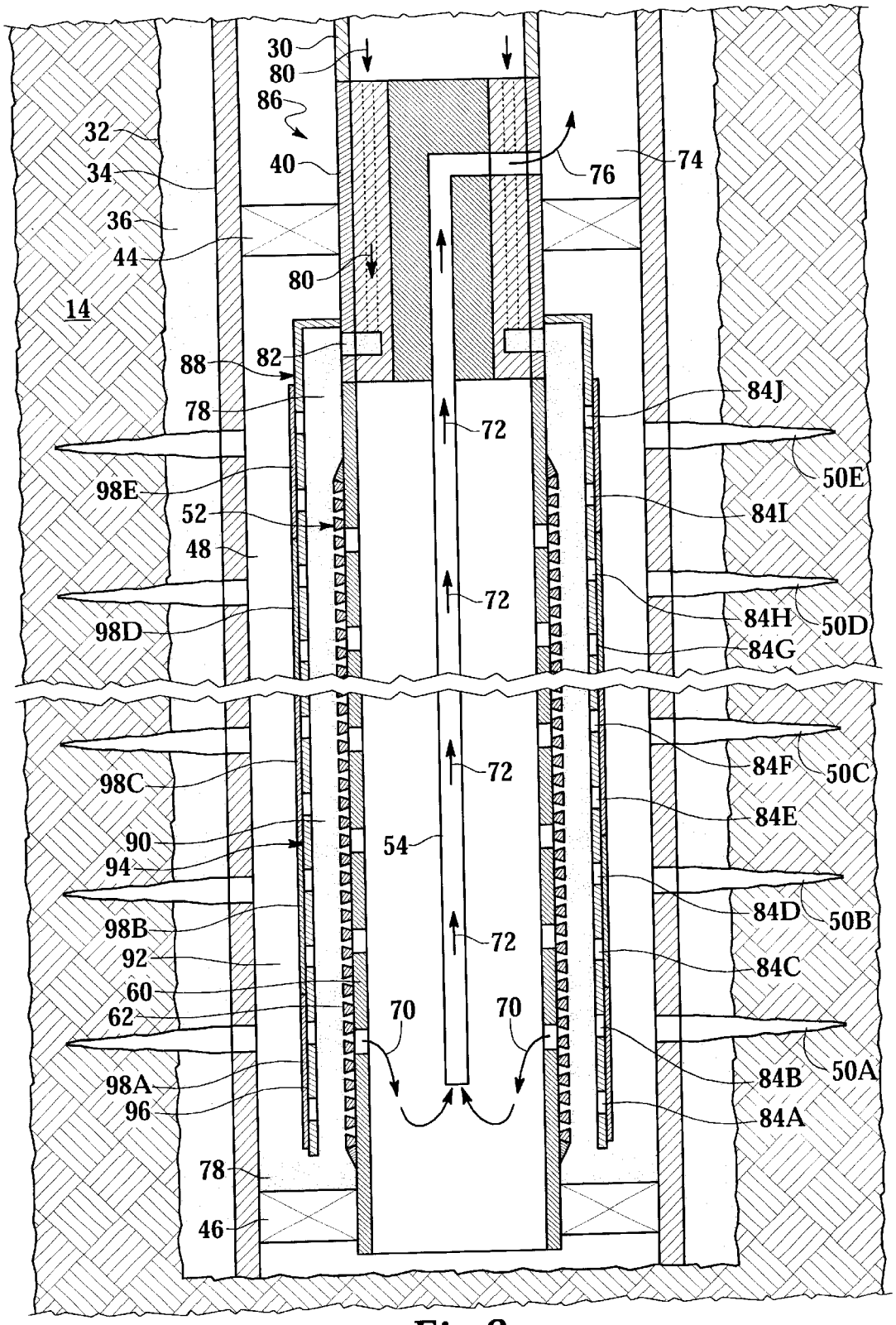
FIG. 8 is a half sectional view of another embodiment of an apparatus for progressively gravel packing an interval of a wellbore of the present invention in its initial position.

Referring now to FIG. 8, therein is depicted an apparatus for progressively gravel packing an interval of a wellbore that is generally designated 86. As illustrated, apparatus 86 includes cross-over assembly 40, a screen assembly 52, gravel packing assembly 88 and a wash pipe 54. Apparatus 86 is connected to work string 30 extending from the surface, which lowers apparatus 86 into wellbore 32 until screen assembly 52 is properly positioned adjacent to formation 14. Gravel packing assembly 88 forms an annulus 90 with screen assembly 52 and an annulus 92 with casing 34.

In the illustrated embodiment, gravel packing assembly 88 includes an axially extending substantially tubular member 94 that includes a perforated pipe 96 and a plurality of removable members 98A–98E disposed on the exterior surface of perforated pipe 96. Apparatus 86 with removable members 98A–98E operates substantially identical to apparatus 38 with removable members 68A–68E except that removable members 98A–98E are removed from the exterior surface of the perforated pipe.

Figure 9:
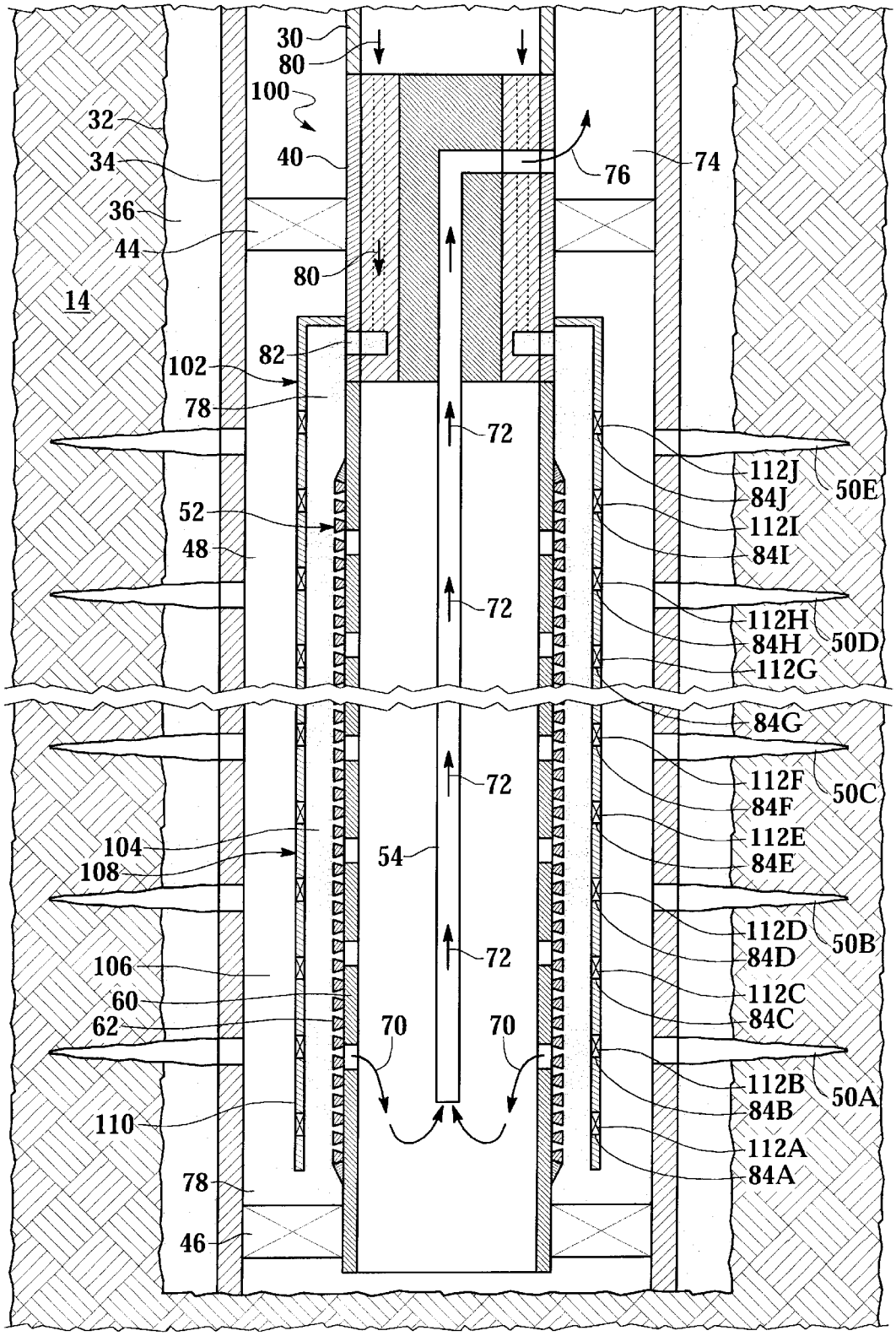
FIG. 9 is a half sectional view of another embodiment of an apparatus for progressively gravel packing an interval of a wellbore of the present invention in its initial position.

Referring now to FIG. 9, therein is depicted an apparatus for progressively gravel packing an interval of a wellbore that is generally designated 100. As illustrated, apparatus 100 includes cross-over assembly 40, a screen assembly 52, gravel packing assembly 102 and a wash pipe 54. Apparatus 100 is connected to work string 30 extending from the surface, which lowers apparatus 100 into wellbore 32 until screen assembly 52 is properly positioned adjacent formation 14. Gravel packing assembly 102 forms an annulus 104 with screen assembly 52 and an annulus 106 with casing 34.

In the illustrated embodiment, gravel packing apparatus 102 includes an axially extending substantially tubular member 108 that includes a perforated pipe 110 and a plurality of actuatable members 112A–112J disposed within the perforations of perforated pipe 110. Actuatable members 112A–112J may be operated by a variety of known techniques including pressure actuation, electrical actuation, acoustic actuation or the like. Examples of suitable actuatable members 112A–112J include rupture disks, valves, such as one way valves and the like.

When actuatable members 112A–112J are designed to be directly pressure actuated, the pressure required to actuate the actuatable members 112A–112J is progressively increases from the end of interval 48 toward cross-over assembly 40. For example, more pressure may be required to actuate actuatable member 112B than 112A, while more pressure is required to actuate actuatable member 112C than 112B and so forth along interval 48. Alternatively, groups of actuatable members 112 may be actuated together such that actuatable members 112A–112B actuate at the same pressure while actuatable members 112C–112D actuate at a higher pressure. Each adjacent actuatable member or group of actuatable members may be set to actuate at increments such as 50–100 psi. This assures a proper progression of the gravel pack by preventing any out of sequence actuations. In addition, as stated above, this approach is particularly advantageous in that the incremental pressure increase of adjacent actuatable members or groups of actuatable members helps to assure that each section of the gravel pack is tightly packed prior to initiating the gravel packing of subsequent sections.

Alternatively, a wireless telemetry system may be used to progressive actuate actuatable members 112A–112J. In this case, one or a group of actuatable members 112A–112J may be actuated a particularly addressed wireless signal. This assures a proper progression of the gravel pack by preventing any out of sequence activations. As explained above, the wireless signals may be manually or automatically initiated based upon the pressure response in annulus 104 in a manner that insures that each section of the gravel pack is tightly packed prior to initiating the gravel packing of subsequent sections.

In the case where actuated devices 112 are valves, once the gravel packing operation is complete, the valve may be locked open using, for example, a wireless telemetry system to allow production fluids to flow therethrough. Alternatively, other perforations in perforate pipe 110 that did not include valves but were plugged during the gravel packing operation may be unplugged to allow production fluids to flow therethrough.

Figure 10:
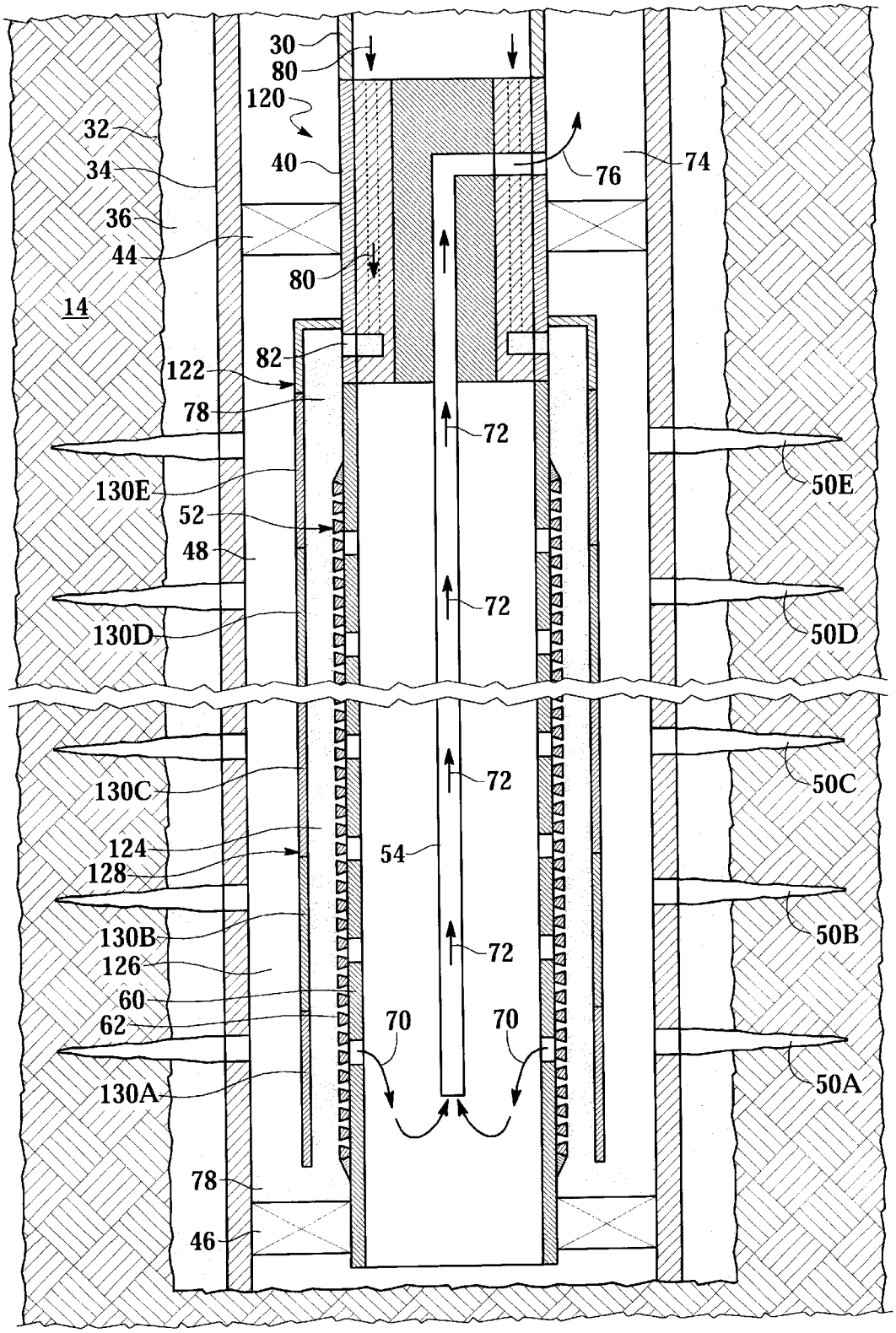
FIG. 10 is a half sectional view of yet another embodiment of an apparatus for progressively gravel packing an interval of a wellbore of the present invention in its initial position.

Referring now to FIG. 10, therein is depicted an apparatus for progressively gravel packing an interval of a wellbore that is generally designated 120. As illustrated, apparatus 120 includes cross-over assembly 40, a screen assembly 52, gravel packing assembly 122 and a wash pipe 54. Apparatus 120 is connected to work string 30 extending from the surface, which lowers apparatus 120 into wellbore 32 until screen assembly 52 is properly positioned adjacent formation 14. Gravel packing assembly 122 forms an annulus 124 with screen assembly 52 and an annulus 126 with casing 34.

In the illustrated embodiment, gravel packing assembly 122 includes an axially extending substantially tubular member 128 that includes a plurality of removable members 130A–130E. Apparatus 120 with removable members 130A–130E operates substantially identical to apparatus 38 with removable members 68A–68E except that removable members 130A–130E are not associated with a perforated pipe.

In operation, the apparatus for progressively gravel packing an interval of a wellbore of the present invention is used to progressively distribute the fluid slurry containing gravel to various locations within the interval to be gravel packed by progressively allowing fluid communication between a first annulus and a second annulus. As this fluid communication is sequentially established in adjacent sections of the interval, the gravel in the fluid slurry fills that section of the interval from the formation to the sand control screen. This process progresses along the entire length of the interval such that the interval becomes completely packed with the gravel. Once the interval is completely packed with gravel, the gravel pack operation may cease. As such, once the gravel pack is complete and the well is brought on line, formation fluids that are produced into the gravel packed interval must travel through the gravel pack in the interval, prior to entering the screen assembly, thereby filtering out any particulate materials in the formation fluid.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for progressively gravel packing an interval of a wellbore comprising:

a sand control screen positioned within the wellbore; and a tubular member disposed within the wellbore forming a first annulus with the sand control screen and a second annulus with the wellbore, the tubular member initially substantially preventing fluid communication between the first annulus and the second annulus, the tubular member selectively allowing fluid communication from the first annulus to the second annulus by progressively establishing fluid communication between the first annulus and the second annulus from a first end to a second end of the interval.

2. The apparatus as recited in claim 1 wherein the tubular member further comprises a plurality of propellant members that are selectively combustible from the first end to the second end of the interval.

3. The apparatus as recited in claim 2 wherein each of the propellant members further comprises an initiator.

4. The apparatus as recited in claim 3 wherein the initiators further comprise initiators that are activated by a wireless telemetry system.

5. The apparatus as recited in claim 3 wherein the initiators further comprise pressure activated firing devices.

6. The apparatus as recited in claim 5 wherein the pressure activated firing devices are positioned such that the pressure required to fire the pressure activated firing devices progressively increasing from the first end to the second end.

7. The apparatus as recited in claim 2 wherein the plurality of propellant members are disposed on the interior of a perforated pipe.

8. The apparatus as recited in claim 2 wherein the plurality of propellant members are disposed on the exterior of a perforated pipe.

9. The apparatus as recited in claim 1 wherein the tubular member further comprises a perforated pipe, each of the perforations having an actuatable device disposed therein.

10. The apparatus as recited in claim 9 wherein the actuatable devices are rupture disks that are positioned within the perforated pipe such that the pressure required to actuate the rupture disks progressively increases from the first end to the second end.

11. The apparatus as recited in claim 9 wherein the actuatable devices are pressure actuated one-way valves that are positioned within the perforated pipe such that the pressure required to actuate the one-way valves progressively increases from the first end to the second end.

12. The apparatus as recited in claim 9 wherein the actuatable devices are one-way valves that are progressively actuated from the first end to the second end by a wireless telemetry system.

13. The apparatus as recited in claim 1 wherein the first end is closer to the bottom of the wellbore than the second end.

14. The apparatus as recited in claim 1 wherein the first end is closer to the top of the wellbore than the second end.

15. The apparatus as recited in claim 1 wherein the first end is closer to the toe of the wellbore than the second end.

16. The apparatus as recited in claim 1 wherein the first end is closer to the heel of the wellbore than the second end.

17. The apparatus as recited in claim 1 wherein the tubular member further comprises a plurality of friable members that are progressively removable from the first end to the second end of the interval.

18. The apparatus as recited in claim 17 wherein each of the friable members further comprises a pressure actuated vibration generator and wherein the pressure actuated vibration generators are positioned such that the pressure required to activate the pressure actuated vibration generators progressively increasing from the first end to the second end.

19. The apparatus as recited in claim 17 wherein each of the friable members further comprises a vibration generator and wherein the vibration generators are progressively activated from the first end to the second end by a wireless telemetry system.

20. An apparatus for progressively gravel packing an interval of a wellbore comprising:

a sand control screen positioned within the wellbore; and a tubular member disposed within the wellbore forming a first annulus with the sand control screen and a second annulus with the wellbore, the tubular member including a perforated pipe and a plurality of propellant members disposed thereon, each propellant member having a pressure activated firing device associated therewith the pressure activated firing devices are positioned such that the pressure required to fire the pressure activated firing devices progressively increases from a first end to a second end of the interval, thereby progressively allowing fluid communication from the first annulus to the second annulus as the pressure created by a fluid slurry containing gravel pumped into the first annulus progressively increases from the first end to the second end such that the wellbore is substantially completely gravel packed from the first end to the second end.

21. The apparatus as recited in claim 20 wherein the first end is closer to the bottom of the wellbore than the second end.

22. The apparatus as recited in claim 20 wherein the first end is closer to the top of the wellbore than the second end.

23. The apparatus as recited in claim 20 wherein the first end is closer to the toe of the wellbore than the second end.

24. The apparatus as recited in claim 20 wherein the first end is closer to the heel of the wellbore than the second end.

25. A method for progressively gravel packing an interval of a wellbore, the method comprising the steps of:

traversing a formation with the wellbore;

locating a sand control screen within the wellbore proximate the formation;

positioning a tubular member within the wellbore that forms a first annulus between the tubular member and the sand control screen and a second annulus between the tubular member and the wellbore;

initially substantially preventing fluid communication between the first annulus and the second annulus;

injecting a fluid slurry containing gravel into the first annulus;

progressively establishing fluid communication between the first annulus and the second annulus from a first end to a second end of the interval; and terminating the injecting.

26. The method as recited in claim 25 wherein the step of positioning a tubular member within the wellbore further comprises disposing a plurality of propellant members within the wellbore and wherein the step of progressively establishing fluid communication between the first annulus and the second annulus from a first end to a second end of the interval further comprises progressively combusting the propellant members from the first end to the second end.

27. The method as recited in claim 26 wherein the step of progressively combusting the propellant members from the first end to the second end further comprises initiating the combustion with a wireless telemetry system.

28. The method as recited in claim 26 wherein the step of progressively combusting the propellant members from the first end to the second end further comprises initiating the combustion with pressure activated firing devices.

29. The method as recited in claim 28 wherein the step of initiating the combustion with pressure activated firing devices further comprises positioning the pressure activated firing devices such that the pressure required to fire the pressure activated firing devices progressively increases from the first end to the second end.

30. The method as recited in claim 26 wherein the step of disposing a plurality of propellant members within the wellbore further comprises disposing the plurality of propellant members on the interior of a perforated pipe.

31. The method as recited in claim 26 wherein the step of disposing a plurality of propellant members within the wellbore further comprises disposing the plurality of propellant members on the exterior of a perforated pipe.

32. The method as recited in claim 25 wherein the step of positioning a tubular member within the wellbore further comprises disposing a pressure actuatable device in each perforation of a perforated pipe such that the pressure required to actuate the pressure actuatable devices progressively increases from the first end to the second end.

33. The method as recited in claim 32 wherein the step of disposing a pressure actuatable device in each perforation of a perforated pipe further comprises disposing a rupture disk in each perforation.

34. The method as recited in claim 32 wherein the step of disposing a pressure actuatable device in each perforation of a perforated pipe further comprises disposing a one-way valve in each perforation.

35. The method as recited in claim 25 wherein the step of progressively establishing fluid communication between the first annulus and the second annulus from a first end to a second end of the interval further comprises positioning the first end closer to the bottom of the wellbore than the second end.

36. The method as recited in claim 25 wherein the step of progressively establishing fluid communication between the first annulus and the second annulus from a first end to a second end of the interval further comprises positioning the first end closer to the top of the wellbore than the second end.

37. The method as recited in claim 25 wherein the step of progressively establishing fluid communication between the first annulus and the second annulus from a first end to a second end of the interval further comprises positioning the first end closer to the toe of the wellbore than the second end.

38. The method as recited in claim 25 wherein the step of progressively establishing fluid communication between the first annulus and the second annulus from a first end to a second end of the interval further comprises positioning the first end closer to the heel of the wellbore than the second end.

39. The method as recited in claim 25 wherein the step of positioning a tubular member within the wellbore further comprises disposing a one-way valves in each perforation of a perforated pipe and progressively actuating the one-way valves from the first end to the second end with a wireless telemetry system.

40. The method as recited in claim 25 wherein the step of positioning a tubular member within the wellbore further comprises positioning a plurality of friable members within the wellbore.

41. The method as recited in claim 40 further comprising the step of progressively removing the friable members from the first end to the second end by progressively actuating pressure actuate vibration generators coupled to the friable members that are positioned such that the pressure required to actuate the pressure actuate vibration generators progressively increasing from the first end to the second end.

42. The method as recited in claim 40 further comprising the step of progressively removing the friable members from the first end to the second end by progressively actuating vibration generators coupled to the friable members with a wireless telemetry system.

43. A method for progressively gravel packing an interval of a wellbore, the method comprising the steps of:

traversing a formation with the wellbore;

locating a sand control screen within the wellbore proximate the formation;

positioning a tubular member including a perforated pipe and a plurality propellant members disposed thereon within the wellbore that forms a first annulus between the tubular member and the sand control screen and a second annulus between the tubular member and the wellbore;

initially substantially preventing fluid communication between the first annulus and the second annulus;

injecting a fluid slurry containing gravel into the first annulus;

progressively establishing fluid communication between the first annulus and the second annulus from a first end to a second and of the interval by activating pressure activated firing devices coupled to each propellant member, the pressure activated firing devices being positioned such that the pressure required to fire the pressure activated firing devices progressively increases from the first end to the second end; and terminating the injecting.

44. The method as recited in claim 43 wherein the step of progressively establishing fluid communication between the first annulus and the second annulus from a first end to a second end of the interval further comprises positioning the first end closer to the bottom of the wellbore than the second end.

45. The method as recited in claim 43 wherein the step of progressively establishing fluid communication between the first annulus and the second annulus from a first end to a second end of the interval further comprises positioning the first end closer to the top of the wellbore than the second end.

46. The method as recited in claim 43 wherein the step of progressively establishing fluid communication between the first annulus and the second annulus from a first end to a second end of the interval further comprises positioning the first end closer to the toe of the wellbore than the second end.

47. The method as recited in claim 43 wherein the step of progressively establishing fluid communication between the first annulus and the second annulus from a first end to a second end of the interval further comprises positioning the first end being closer to the heel of the wellbore than the second end.

48. A method for progressively gravel packing an interval of a wellbore, the method comprising the steps of:

providing a casing within the wellbore traversing a formation;

perforating the casing proximate the formation to form a plurality of perforations;

locating a sand control screen within the wellbore proximate the formation;

positioning a tubular member within the wellbore that forms a first annulus between the tubular member and the sand control screen and a second annulus between the tubular member and the casing;

initially substantially preventing fluid communication between the first annulus and the second annulus;

injecting a fluid slurry containing gravel into the first annulus;

progressively establishing fluid communication between the first annulus and the second annulus from a first end to a second end of the interval; and terminating the injecting.

* * * * *